US008096213B2

(12) United States Patent
Miers

(10) Patent No.: US 8,096,213 B2
(45) Date of Patent: Jan. 17, 2012

(54) UTILITY INSERT TOOL WITH SPHERICAL RETAINING BALL MEMBER AND TORSION BAR FOR SECURING DETACHABLE UTILITY INSERTS

(76) Inventor: Neil Miers, Houston, TX (US)

( * ) Notice: Subject to any disclaimer, the term of this patent is extended or adjusted under 35 U.S.C. 154(b) by 46 days.

(21) Appl. No.: 11/941,432

(22) Filed: Nov. 16, 2007

(65) Prior Publication Data

US 2009/0126538 A1 May 21, 2009

(51) Int. Cl.
*B25B 23/00* (2006.01)

(52) U.S. Cl. ..... 81/177.85; 81/438; 81/439

(58) Field of Classification Search ..... 81/177.85, 81/177.1, 177.2, 437–439, 491
See application file for complete search history.

(56) References Cited

U.S. PATENT DOCUMENTS

| | | | | |
|---|---|---|---|---|
| 730,509 | A * | 6/1903 | Baker | 403/4 |
| 759,042 | A * | 5/1904 | Swan | 279/78 |
| 5,477,758 | A * | 12/1995 | Cunningham | 81/177.85 |
| 5,685,208 | A * | 11/1997 | Tidwell | 81/177.85 |
| 6,606,925 | B1 * | 8/2003 | Gmeilbauer | 81/177.1 |
| 2006/0230885 | A1 * | 10/2006 | Olson | 81/177.85 |
| 2007/0062346 | A1 * | 3/2007 | Hsieh | 81/177.7 |

* cited by examiner

*Primary Examiner* — Debra S Meislin
(74) *Attorney, Agent, or Firm* — Fulbright & Jaworski L.L.P.

(57) ABSTRACT

A body having one or more apertures to receive a variety of detachable utility inserts. The body being shaped with a spherical ball retainer member and/or a torsion bar for engaging a corresponding spherical indentation and notch formed on the utility insert. The body further including a lever for locking and unlocking the utility insert from the body.

3 Claims, 3 Drawing Sheets

UTILITY INSERT TOOL WITH SPHERICAL RETAINING BALL MEMBER AND TORSION BAR FOR SECURING DETACHABLE UTILITY INSERTS

TECHNICAL FIELD

The present invention relates to a utility insert tool, and more particularly to a utility insert tool adapted to securely hold a plurality of detachable utility inserts.

BACKGROUND OF THE INVENTION

Various types of known hand tools presently employ the use of interchangeable bits for rotating fasteners. For example, screw driver bits and shafts are often detachably coupled with a body by friction, locking members, clamps, threads and the like.

The problem with known types of hand tools is that detachable bits fail to securely couple to the body during use of the tool. Over time and repeated use, additional problems anise as the structural integrity of the detachable bits break down, resulting in frequent uncoupling. In addition, storage and transport of the detachable bits often proves difficult due to lack of efficient organization and carrying features.

The present invention mitigates the aforementioned disadvantages by providing a durable body for securely coupling with a detachable utility inserts. The present invention also provides the advantage of easy transport and organization of such utility inserts.

BRIEF SUMMARY OF THE INVENTION

In one embodiment, the utility insert tool includes a body formed with one or more apertures for holding a variety of detachable utility inserts. The apertures include a spherical ball retainer member and/or a torsion bar adapted to engage and the detachable utility insert. The aperture is preferably shaped with a rectangular recess that corresponds with the rectangular shape of the utility insert, forming a precision fit. The utility insert is formed with one or more spherical indentations for frictionally engaging the spherical ball retainer member inside of the aperture. The utility insert is also formed with one or more notches for frictionally engaging the torsion bar inside of the aperture. In the preferred embodiment, the utility insert includes two notches, one on each lateral end of the insert, and two spherical indentations, one on each longitudinal side of the insert. The notches and spherical indentations are sized so that the utility insert can be inserted in the apertures right side down or upside down.

In another embodiment, a utility insert tool comprises a body with a first aperture for receiving a utility insert; a first ball retainer movably disposed within the first aperture for engaging a utility insert; and a first torsion bar rotateably coupled to the body for engaging a utility insert. Optionally, the first aperture is sized for an interference fit with a utility insert. The first torsion bar may also include a hook disposed into the first aperture. The body optionally further comprises a second aperture aligned with the first aperture. The body also optionally further comprises a third aperture perpendicular with the body's longitudinal axis.

In another embodiment, the utility insert tool comprises a second torsion bar with a hook that is rotateably coupled to the body, wherein the hook of the second torsion bar is disposed into the second aperture; and a straight bar slideably coupled to the body, wherein the end of the straight bar is disposed into the third aperture. Optionally, the apertures are sized and shaped to receive the same utility insert. The utility insert may further comprise a second ball retainer disposed within the second aperture and a third ball retainer disposed within the third aperture.

In another embodiment, the tool system further comprises a body; at least one aperture having a generally rectangular recess within at least a portion of the body, wherein the aperture is adapted to receive a detachable utility insert; and at least one movable torsion bar coupled within a channel formed in the body, wherein the torsion bar is adapted to selectively engage a detachable utility insert received in the aperture. Optionally, the aperture further comprises at least one spherical ball retainer member, wherein a portion of the spherical ball retainer member is movably biased beyond the surface of the inner wall of the aperture to engage a detachable utility insert received in the aperture. The tool optionally further comprises at least one detachable utility insert having a shank end sized and shaped to be inserted in the at lest one aperture, wherein the shank end is formed with a spherical indentation and notch for maintaining gripping frictional engagement with the spherical ball retainer member and the torsion bar. Optionally, at least one detachable utility insert is formed with a ratcheting mechanism for selectively driving a fastener.

In another embodiment, a tool comprises a body; at least one aperture formed within the body, wherein the aperture is adapted to receive at least a portion of a detachable utility insert; at least one spherical ball retainer member movably disposed within at least a portion of the aperture, wherein a portion of the spherical ball retainer member is movably biased beyond the surface of the inner wall of the aperture to engage a detachable utility insert; at least one torsion bar movably coupled with the body, wherein the torsion bar is adapted to engage a detachable utility insert inserted in the aperture; and at least one detachable utility insert having a shank end adapted to couple with the aperture, the shank end having at least one spherical indentation and at least one notch, wherein the spherical indentation is adapted to engage the spherical ball retainer member and the notch is adapted to couple with the torsion bar to couple the body with the detachable utility insert.

In another embodiment, the utility insert tool system comprises a body with an aperture for receiving a utility insert; a torsion bar rotateably coupled to the body for engaging a utility insert; and a utility insert adapted to be received by the aperture and engaged by the torsion bar. The utility insert optionally has a shank end formed with notch for engaging the first torsion bar. The utility insert may also have a shank end formed with a hole for receiving a key ring. In another embodiment, the utility insert has a tip end generally opposite the shank end for driving fasteners. Optionally, the tip end is formed with a ratchet. In a further embodiment, the tip end is formed to engage a fastener having a recessed head selected from the group comprising slotted, Phillips, parallel, taper to point, pozidriv, torx, hex, robertson, tri-wing, torq-set, and spanner head.

In another embodiment, the utility tool system comprises a body with a rectangular aperture for receiving a utility insert; and a rectangular utility insert adapted to be received by the aperture to form a precision fit, wherein the cross section of the aperture and the utility insert exhibit greater longitudinal dimension than lateral dimension. The body optionally comprises a torsion bar member and the utility insert comprises a notch, the torsion bar and notch adapted to couple the utility insert to the body. The utility insert tool optionally comprises two spherical indentations, one on each longitudinal side, so that the utility insert can be inserted right side up or upside down. The body may also comprise a ball retainer and the utility insert comprises a spherical indentation, the ball retainer and spherical indentation adapted to couple the utility insert to the body. The utility insert tool may also comprise two notches, one on each lateral side, so that the utility insert can be inserted right side down or upside down.

The foregoing has broadly outlined certain objectives, features, and technical advantages of the present invention in order that the detailed description of the invention that follows may be better understood. Additional features and advantages of the invention are described hereinafter, and form the subject of certain claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages are better understood from the following description when considered in connection with the accompanying figures. It is to be expressly understood, however, that such description and figures are provided for the purpose of illustration and description only and are not intended as a definition of the limits of the present invention. For example, although embodiments discussed herein include a body with one aperture adapted with a means for securing (e.g., a spherical ball retainer member and torsion bar) a utility insert it should be appreciated that more than one aperture, each having more than one securing means, are included in embodiments of the present invention.

DETAILED DESCRIPTION OF THE INVENTION

Figure 1:
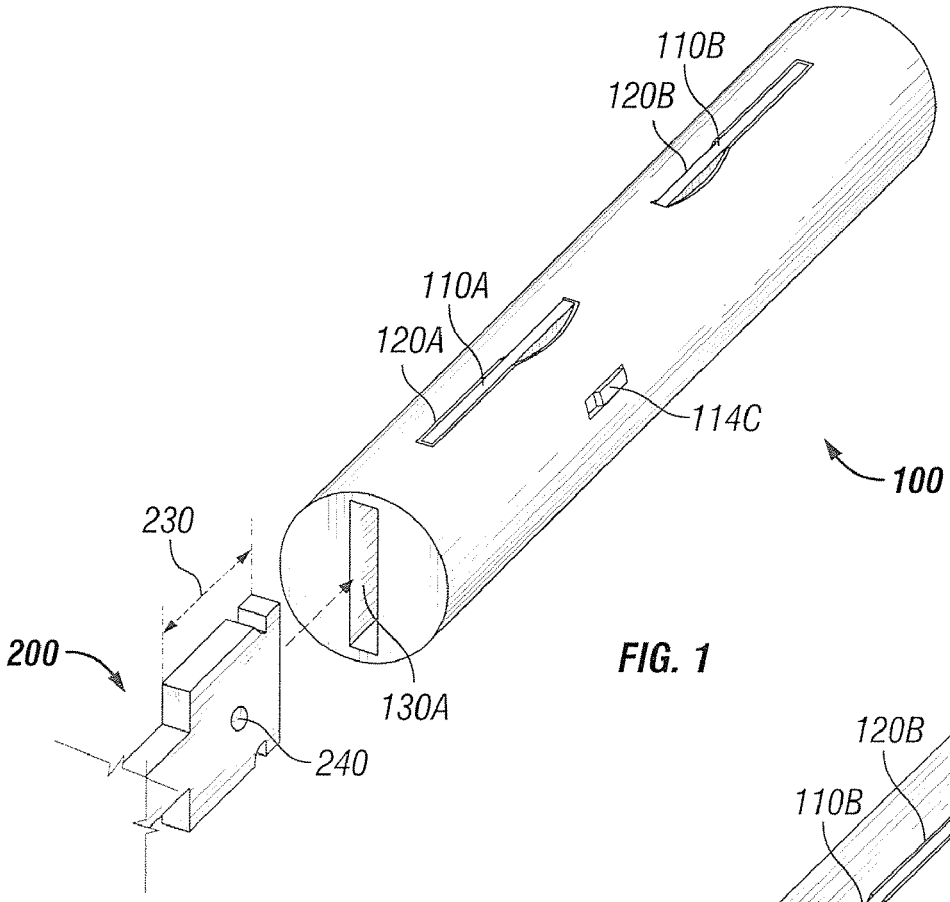
FIG. 1 illustrates a utility insert tool with a round cross-section.
Figure 1A:
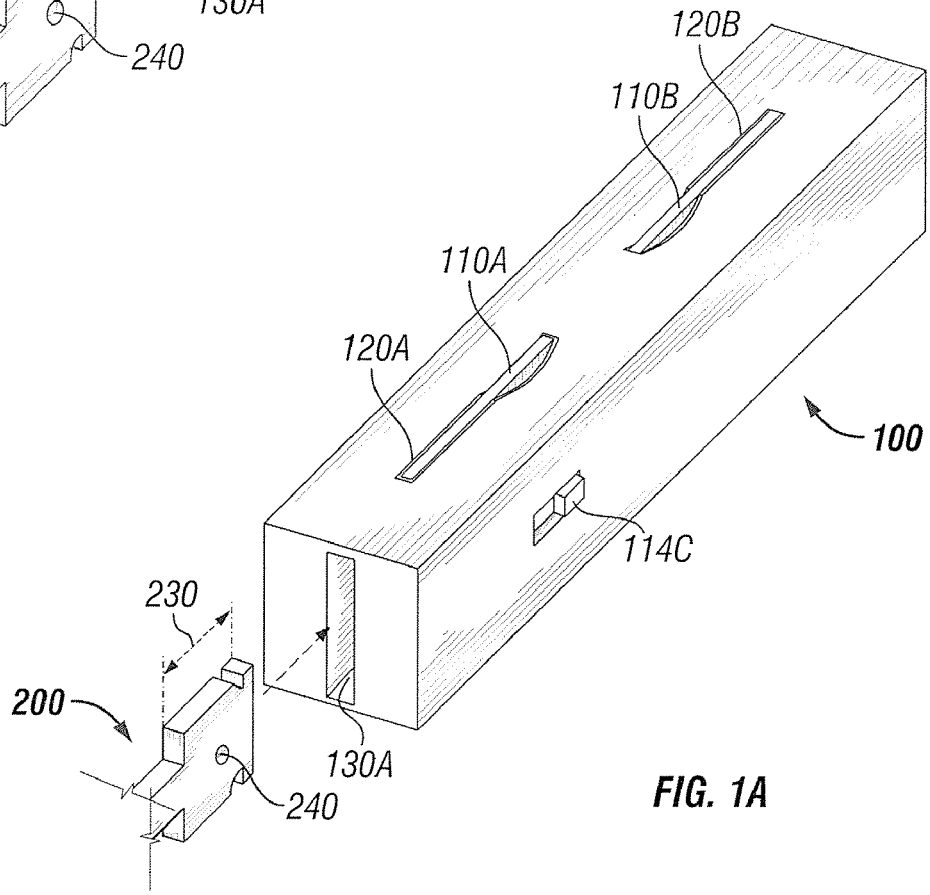
FIG. 1A illustrates a utility insert tool with a rectangular cross-section.

FIG. 1 illustrates a utility insert tool with body 100. Body 100 may have a round cross section, as shown in FIG. 1, or other cross sectional shapes. For example, FIG. 1A shows body 100 with a rectangular cross-section. Body 100 is preferably constructed of durable plastic, metal or wood that has sufficient strength to withstand torsion and impact loads. Body 100 may include a sheath or coating to enhance grip. Body 100 is adapted to receive utility insert 200 such that, during use, the coupled parts form a tool capable of withstanding the force used to rotate and drive fasteners. Body 100 is long enough to be comfortably gripped by one hand. Alternative embodiments, however, may be long enough to be gripped comfortably by two hands.

The utility insert tool includes at least a first aperture 130A, formed in the end of body 100. Aperture 130A is a recess for receiving utility insert 200. In a preferred embodiment, aperture 130A is an elongated rectangular recess that corresponds to the shape of shank 230. The rectangular recess is sized to that the height of the aperture is greater than the width. The rectangular shape includes a height vs. width ratio of 4 to 1, for example (e.g., the longitudinal sides are four times the length of the lateral sides). In another preferred embodiment, the longitudinal sides are ⅝ inches and the lateral sides are 3/16 inches. Utility inserts of longer longitudinal dimensions prevent stripping, particularly when compared to square shaped alternatives. One of skill in the art will appreciate that the height vs. width ratio can be adjusted.

Aperture 130A and shank 230 are optimally sized for a precision fit. However, other relationships are envisioned, such as interference and friction fits, for example. Aperture 130A and shank 230 may also be tapered such that their surfaces engage in around the last 14 inch of insertion. In this manner, only the last 14 inch of the utility insert 200 preferably results in an interference fit with the aperture 130A. In another embodiment, the taper can run the longitudinal length of the aperture 130A. That is, the internal longitudinal walls of the aperture 130A taper toward the back of the aperture, such that the front part of the aperture is wider than the back of the aperture. In still a further embodiment, the taper begins at any point within the aperture, such that opposite internal walls of the aperture 130A are parallel for a specified length, and then they narrow further into the handle.

Optionally, the internal wall opposite the aperture's opening is fitted with a resilient material. When the utility insert is locked in the aperture, the insert applies a longitudinal force to the resilient material compressing it slightly. The torsion bar is actuated to unlock the utility insert, which causes the resilient material to decompress, thus slightly ejecting the utility insert from the aperture. In another embodiment, the resilient material is fitted on shank 230, rather than to the aperture. In further embodiments, both the shank 230 and aperture 130A include resilient material for ejecting the utility insert 200. The resilient material is preferably formed of a light weight elastomer or o-ring, for example. Alternatively, the resilient material is formed of a flexible metal and/or spring mechanism resistant to compression.

Figure 2:
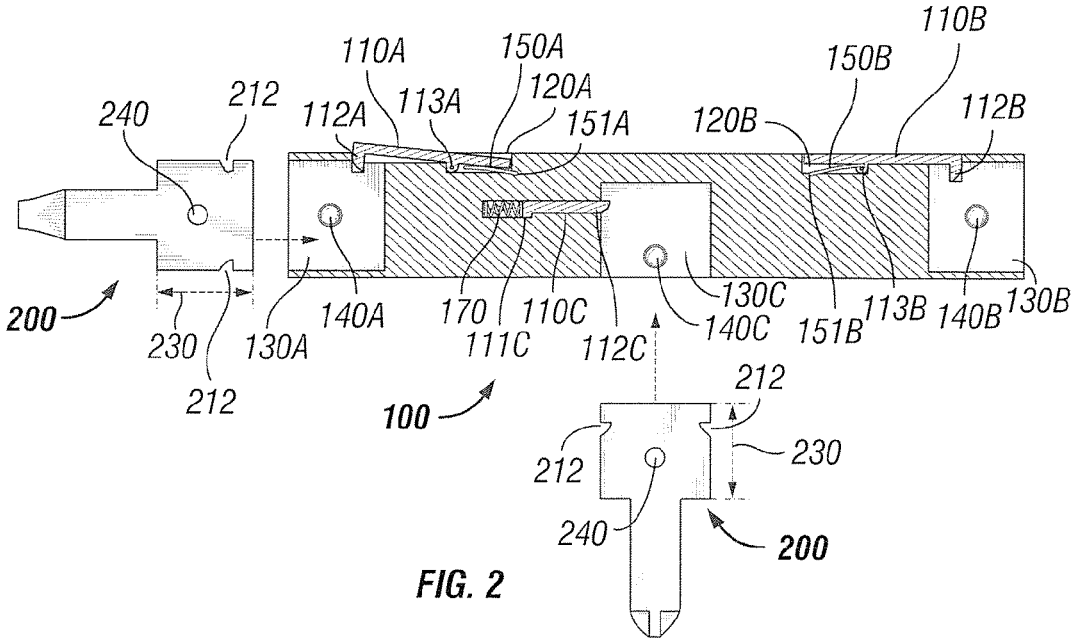
FIG. 2 illustrates a section view of utility insert tool.

As show in FIG. 2, body 100 is optionally formed with a first aperture 130A and second aperture 130B. In the embodiment shown in FIG. 2, apertures 130A, 130B, body 100, and utility insert 200 have a common longitudinal axis. Body 100 may also include a third aperture 130C formed on the side of body 100. Third aperture 130C is preferably configured so to that utility insert 200, when inserted, will be parallel to body 100's lateral axis. It is appreciated that different embodiments of body 100 may include all or any of apertures 130A, 130B or 130C, or combinations.

The utility insert tool also includes one or more torsion bars 110A, 110B. Torsion bars 110A, 110B are optionally formed with hooks 112A, 112B. Shown in FIGS. 2 and 3, hooks 112A, 112B are preferably formed with one flat face and one rounded face. The hook's rounded face is preferably adapted to contact the corner of a shank 230 in such a way that the torsion bar 110A or 110B displaces slightly, in an upward or lateral direction, when receiving a utility insert in an aperture 130A or 130B. Straight bar 110C is formed with a similar hook 112C.

In another embodiment, hook 112 is formed as a wedge shape that protrudes laterally from the torsion bar (not shown). The wedge preferably comprises two flat faces for engaging a notch formed on shank 230. The wedge is sized to contact the notch of a utility insert 200, such that the insert snaps into and out of the aperture, flexing the torsion bar upon insertion and removal. To adjust ingress/egress resistance of the utility insert to the aperture, the angle between the hook's two faces are steepened or lessened, as desired. The angle between the notch's faces may also be steepened or lessened to adjust resistance, as desired.

Torsion bars 110A, 110B include pivot holes 113A, 113B. Pivot holes 113A, 113B are sized to receive pins 160A, 160B (see FIG. 3). Torsion bars 110A, 110B are constructed from metal or alloy to resist twisting or bending.

Figure 3:
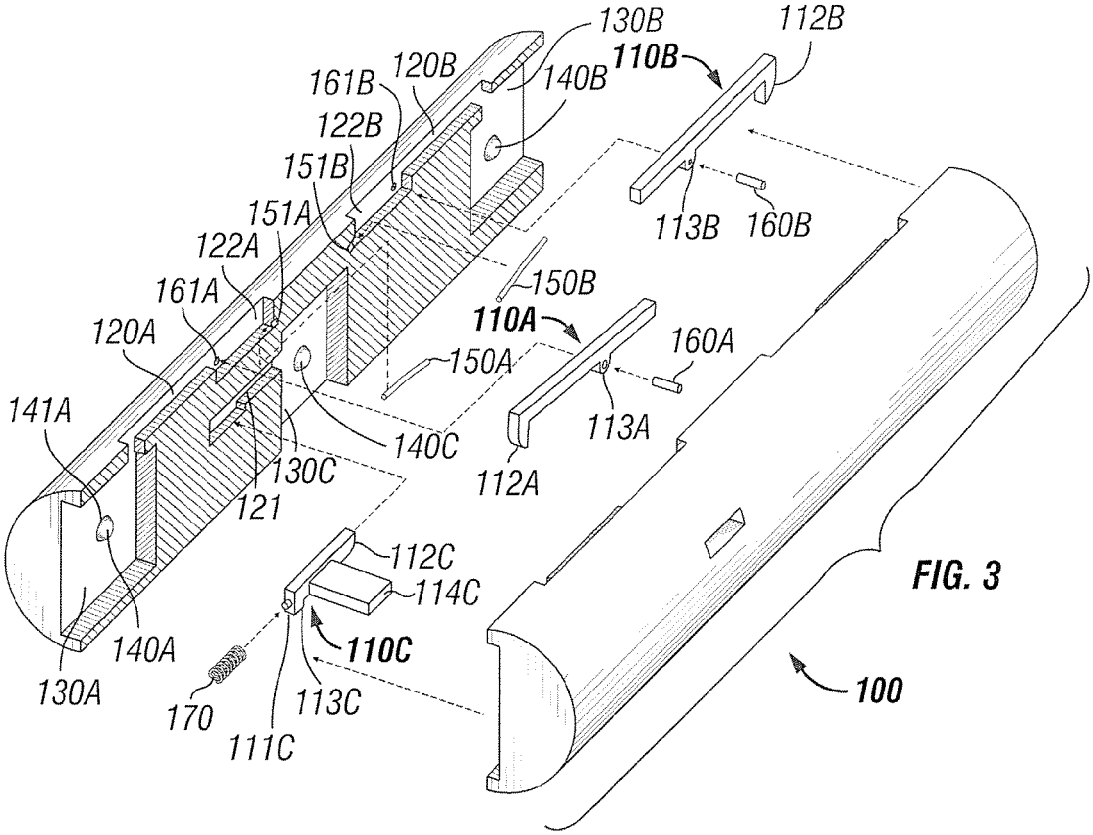
FIG. 3 illustrates an exploded view of a utility insert tool for receiving utility inserts.

Shown in FIG. 3, torsion bars 110A, 110B are seated in body 100 in recessed channels 120A, 120B. Recessed channels 120A, 120B preferably include holes 161A, 161B in the side wall that receive pins 160A, 160B. Holes 161A, 161B are positioned to allow torsion bars 110A, 110B to seat flush with the body's outer surface 101 (See FIGS. 1 and 2). Recessed channels 120A, 120B include stepped portions 122A, 122B. Stepped portions 122A, 122B give torsion bars 111A, 111B room to rotate about pins 160A, 160B. Stepped portions 122A, 122B are optionally formed to allow the torsion bars 110A, 110B to move laterally within channels 120A, 120B.

Torsion bars 110A, 110B are disposed in a flat, down position when the utility insert tool is in use. Flexible positioning rods 150A, 150B force the torsion bars 110A and 110B into channels 120A, 120B so that hooks 112A, 112B enter channels 120A, 120B. Positioning rods 150A, 150B are preferably formed of a resilient metal and are adapted to bend slightly when a force is applied, then return to a straight elongated shape when the force is removed. Positioning rods 150A, 150B are mounted in holes 151A, 151B. Positioning rods 150A, 150B are sized to engage torsion bars 110A, 110B with enough force to secure hooks 112A, 112B within notch 212 of utility insert 200.

As shown in FIGS. 2 and 3, body 100 may include a straight bar 110C that is positioned in an internal passageway 121. Straight bar 110C is preferably constructed of a rigid material and formed with a hook 112C on one end. The opposite end 111C is adapted to engage a spring mechanism 170. Spring mechanism 170 pushes hook 112C into aperture 130C. Straight bar 110C may include lip 113C that limits how far straight bar 110C extends into aperture 130C.

When aperture 130C receives utility insert 200, hook 112C retracts slightly against the resistance of the spring mechanism 170 and then extends into notch 212. Straight bar 110C preferably includes a retaining lever 114C for retracting hook 112C.

In another embodiment, one or more ball retainers may be used to secure utility insert 200 in the aperture. As shown in FIGS. 2 and 3, ball retainers 140A, 140B, 140C protrude into apertures 130A, 130B, 130C in order to engage indentation 240. For increased resistance, each aperture may include more than one ball retainer.

FIGS. 4A, 4B, 4C, 4D, 4E, and 4F illustrate a variety of example utility inserts 200. In general, utility inserts 200A-F are used for turning, cutting, prying, ratcheting, mating with, or otherwise driving different types of fasteners.

As shown in FIG. 4, tips 220A-F are formed in a variety of shapes and sizes. For example, tip 220A is an open wrench shape and tip 220B is a closed end wrench (box wrench). Tips 220A, 220B preferably fit a variety of shapes of bolt heads and nuts.

Figure 4A:
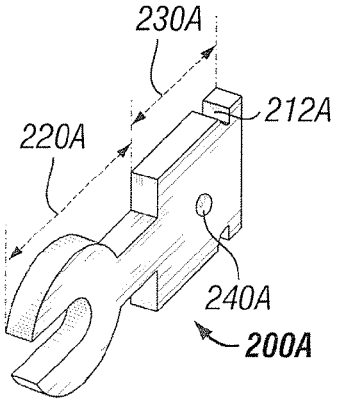
FIG. 4A-4F illustrate example detachable utility inserts.
Figure 4B:
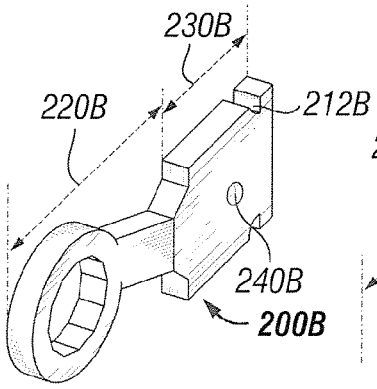
Figure 4C:
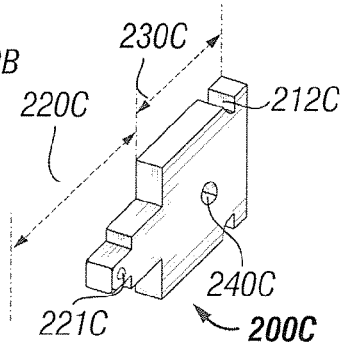

As shown in FIG. 4C, tip 220C is formed with a spherical ball retainer member 221C. Tip 220C is thus adapted to mate with other means for driving fasteners such as sockets, for example.

Figure 4D:
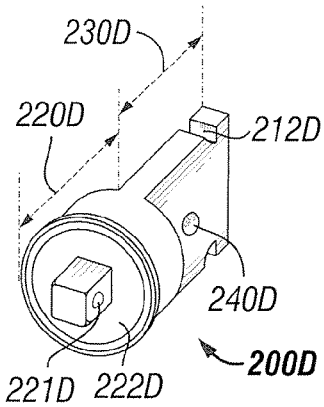

Tip 220D, shown in FIG. 4D, is also formed with a spherical ball retainer member 221D. Tip 220D also includes a ratcheting mechanism 222D. The ratcheting mechanism 222D is preferably designed to rotate in a selectable direction. For example, during clockwise rotation, the ratcheting mechanism 222D locks such that the tip 220D of the utility insert 200 is caused to rotate; during counter clockwise rotation, the ratcheting mechanism 222D unlocks such that rotation of body 100 does not cause the tip 220D of the utility insert 200D to rotate.

Figure 4E:
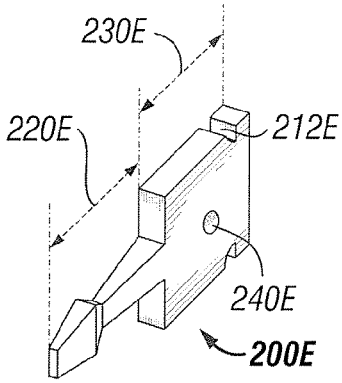
Figure 4F:
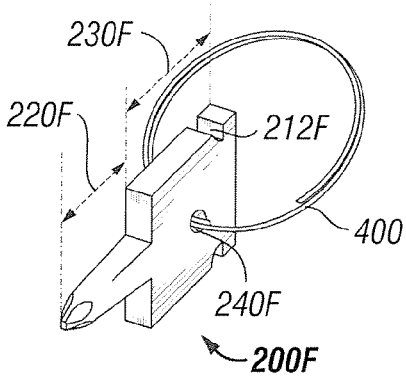

FIGS. 4E and 4F show a slotted (e.g., flathead) screw driver tip 220E and Phillips screw driver tip 220F. Tips 220E and 220F are preferably designed to fit the recessed heads of bolts and screws. However, one of skill in the art will recognize that the slotted 220E and Phillips tip 220F may also be substituted with other types of tips sized and shaped to fit recessed screw heads including parallel, taper to point, pozidriv, torx, hex, robertson, tri-wing, torq-set, spanner head, etc.

In another embodiment, tips 220A-F are formed with a grooved surface (not shown). The grooved surface provides gripping friction so that the tip can be grasped, or pinched, by the user to easily remove the utility insert from the aperture. In one embodiment, surface irregularities are formed on the tip to provide the gripping friction. In another embodiment, a plurality of annular ridges formed on the tip provide the gripping friction.

Reference is made to shank 230A with the understanding that like parts from shanks 230B-F are identified with like numerals. Shank 230A is preferably formed with a protruding rectangular shape, one or more spherical indentations 240A and/or one or more notches 212A. As described above, FIGS. 2 and 3 illustrate how the shank's 230 securing means (notch 212 and spherical indentation 240) correspond with body 100's securing means (hook 112 and spherical ball 140). Thus it is appreciated that shank 230A slidably inserts into aperture 130 to create a frictionally engaged connection. Once inserted, hook 112 engages with notch 212A to secure utility insert 200 in place. For ease of use, shank 230A's cross section preferably includes a notch on each lateral side to that the utility insert can be inserted right side down or upside down, and engage hook 112. Optionally, spherical indentation 240A helps secure utility insert 200 in place. Shank 230A preferably includes a spherical indentation on each longitudinal side so that the utility insert can inserted right side down or upside down, to engage the spherical ball. Ball retainers 240 can also optionally be used in conjunction with or as an alternative to hook 112 to secure utility insert 200 within body 100.

In another embodiment, spherical indentation 240 of utility insert 200 is a hole extending through shank 230 (FIG. 4F). This embodiment permits utility insert 200F (and any other utility inserts described herein) to be stored on a key ring 400 or similar storing device.

For ease of use, the utility insert's shank 230 is formed with an angled corner (not shown). The angled corner is preferably adapted to contact hook 112 such that the torsion bar slightly displaces when inserting the shank 230 into an aperture 130. In this manner, the utility insert 200 is adapted to apply a longitudinal force in a direction against the resistance of torsion bar 110 such that the angled corner to presses against hook, displacing upward or laterally the torsion bar. Once displaced, the utility insert is positioned in the aperture.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A utility insert tool comprising:

a. a body long enough to be comfortably gripped by at least one hand;

b. a first aperture for receiving a utility insert in said body, said first aperture sized for a precision fit with a utility insert;

c. a recessed channel in said body for receiving all or substantially all of a torsion bar such that the body is grippable about said recessed channel; and wherein said recessed channel is positioned relative to said first aperture; and d. a first torsion bar rotateably coupled to said body in said recessed channel for engaging a utility insert said first torsion bar comprising a hook formed with at least a first face and a second face, wherein the first face of said torsion bar is shaped to receive a displacing force from a utility insert being inserted in said first aperture that is different than a displacing force received on said second face from a utility insert being removed from said first aperture; and wherein said hook of said first torsion bar is disposed into said first aperture;

e. a second aperture for receiving a utility insert in said body, said second aperture aligned with said first aperture;

f. wherein said body includes a longitudinal axis extending between said first and second apertures and wherein said body further comprises a third aperture positioned perpendicular with said longitudinal axis, and g. a second torsion bar with a hook that is rotateably coupled to said body, wherein said hook of said second torsion bar is disposed into said second aperture; and a straight bar slideably coupled to said body, wherein the end of said straight bar is disposed in said third aperture.

2. The utility insert tool of claim 1, wherein said apertures are sized and shaped to received the same utility insert.

3. The utility insert of claim 2, further comprising a second ball retainer disposed within said second aperture and a third ball retainer disposed within said third aperture.

* * * * *